US009631250B2

(12) United States Patent
Kawabe et al.

(10) Patent No.: US 9,631,250 B2
(45) Date of Patent: Apr. 25, 2017

(54) HIGH-STRENGTH COLD-ROLLED STEEL SHEET AND METHOD FOR MANUFACTURING THE SAME

(71) Applicant: JFE STEEL CORPORATION, Chiyoda-ku, Tokyo (JP)

(72) Inventors: Hidetaka Kawabe, Tokyo (JP); Takeshi Yokota, Tokyo (JP); Reiko Sugihara, Tokyo (JP); Shigeyuki Aizawa, Tokyo (JP); Kazuki Nakazato, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 135 days.

(21) Appl. No.: 14/383,008

(22) PCT Filed: Feb. 28, 2013

(86) PCT No.: PCT/JP2013/001217

§ 371 (c)(1),
(2) Date: Sep. 4, 2014

(87) PCT Pub. No.: WO2013/132796

PCT Pub. Date: Sep. 12, 2013

(65) Prior Publication Data

US 2015/0034219 A1 Feb. 5, 2015

(30) Foreign Application Priority Data

Mar. 7, 2012 (JP) ..... 2012-050591

(51) Int. Cl.

| | |
|---|---|
| ***C21D 8/02*** | (2006.01) |
| ***C22C 38/14*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C21D 8/04*** | (2006.01) |
| ***C21D 9/48*** | (2006.01) |
| ***C21D 1/25*** | (2006.01) |
| ***C21D 1/26*** | (2006.01) |

(52) U.S. Cl.

CPC ..... *C21D 8/0263* (2013.01); *C21D 1/25* (2013.01); *C21D 1/26* (2013.01); *C21D 8/0226* (2013.01); *C21D 8/0236* (2013.01); *C21D 8/0278* (2013.01); *C21D 8/0473* (2013.01); *C21D 9/48* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C21D 8/0436* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C21D 1/25; C21D 1/26; C21D 8/0226; C21D 8/0236; C21D 8/0263; C21D 8/0278; C21D 8/0436; C21D 8/0473; C21D 9/48; C21D 2211/001; C21D 2211/002; C21D 2211/005; C21D 2211/008; C22C 38/001; C22C 38/002; C22C 38/02; C22C 38/04; C22C 38/06; C22C 38/14

See application file for complete search history.

(56) References Cited

U.S. PATENT DOCUMENTS

| | | | | |
|---|---|---|---|---|
| 8,992,697 | B2 | 3/2015 | Matsuda | |
| 9,121,087 | B2 | 9/2015 | Matsuda | |
| 2009/0314395 | A1* | 12/2009 | Nonaka | B21B 3/02 148/624 |
| 2012/0132327 | A1 | 5/2012 | Mukai | |

FOREIGN PATENT DOCUMENTS

| | | | |
|---|---|---|---|
| CA | 2387322 | | 12/2002 |
| CA | 2679886 | | 10/2008 |
| CA | 2751414 | | 9/2010 |
| EP | 1808505 | | 7/2007 |
| EP | 2105514 | | 9/2009 |
| EP | 2325346 | | 5/2011 |
| EP | 2327810 | | 6/2011 |
| JP | 2004-068050 | A | 3/2004 |
| JP | 2004-308002 | A | 11/2004 |
| JP | 2004-359974 | A | 12/2004 |
| JP | 2005-179703 | A | 7/2005 |
| JP | 2006-283130 | A | 10/2006 |
| JP | 2009068039 | | 4/2009 |
| JP | 2009-203550 | A | 9/2009 |
| JP | 2010-059452 | A | 3/2010 |
| JP | 2010065272 | | 3/2010 |
| JP | 2010-285657 | A | 12/2010 |
| JP | 2011052271 | | 3/2011 |
| JP | 2011144404 | | 7/2011 |
| JP | 2011153336 | | 8/2011 |

(Continued)

OTHER PUBLICATIONS

European Search Report mailed Mar. 31, 2015 for European Application No. 13758658.2.
Mexican Office Action for Mexican Application No. MX/a/2014/010648 dated Aug. 3, 2015, including English translation.
Chinese Office Action dated Aug. 19, 2015 for Chinese Application No. 201380012719.0, including English translation.
Canadian Office Action mailed May 7, 2015 in Canadian Application No. 2,866,130.
Canadian Office Action mailed Nov. 14, 2014 in Canadian Application No. 2,866,130.
International Search Report mailed May 7, 2013 in International Application No. PCT/JP2013/001217.

(Continued)

*Primary Examiner* — Roy King
*Assistant Examiner* — Caitlin Kiechle
(74) *Attorney, Agent, or Firm* — RatnerPrestia

(57) ABSTRACT

A steel sheet has a microstructure including ferrite phase: 40% to 60%, bainite phase: 10% to 30%, tempered martensite phase: 20% to 40%, and retained austenite phase: 5% to 20% by volume fraction, and satisfying a condition that a ratio of tempered martensite phase having major axis length ≤5 μm to a total volume fraction of the tempered martensite phase is 80% to 100%.

3 Claims, No Drawings

(56) References Cited

FOREIGN PATENT DOCUMENTS

| | | | |
|---|---|---|---|
| JP | 2011-184758 | A | 9/2011 |
| JP | 2011225976 | | 11/2011 |
| MX | 2011002559 | | 4/2011 |
| WO | 2010137343 | | 12/2010 |
| WO | WO 2011/065591 | A | 6/2011 |
| WO | 2011111333 | | 9/2011 |

* cited by examiner

HIGH-STRENGTH COLD-ROLLED STEEL SHEET AND METHOD FOR MANUFACTURING THE SAME

CROSS REFERENCE TO RELATED APPLICATIONS

This is the U.S. National Phase application of PCT/JP2013/001217, filed Feb. 28, 2013, which claims priority to Japanese Patent Application No. 2012-050591, filed Mar. 7, 2012, the disclosures of each of these applications being incorporated herein by reference in their entireties for all purposes.

FIELD OF THE INVENTION

The present invention relates to a high-strength cold-rolled steel sheet having excellent formability, which can be suitably used in framework parts of automobiles that are required to be press-formed into complicated shapes, and relates to a method for manufacturing the same. In the present invention, retained austenite phase is used as metallographic structure, martensite phase is temper softened and the size of the tempered martensite phase is controlled without intentionally adding expensive elements such as Nb, V, Cu, Ni, Cr, Mo, etc. in particular, thereby obtaining homogeneous and fine microstructure. The present invention is aimed at realizing a high-strength cold-rolled steel sheet having tensile strength (TS): 1180 MPa or more as well as improving elongation (El) and stretch flangeability (typically evaluated in terms of hole expansion ratio (λ)), and even bending properties thereof.

BACKGROUND OF THE INVENTION

In recent years, in order to improve fuel efficiency by reducing the weight of automobile bodies and to improve collision safety, application of the steel sheets having a tensile strength (TS) of 980 MPa or more to automobile framework parts has been positively promoted. Recently, the application of even stronger steel sheets has been studied.

High strength steel sheets with TS: 1180 MPa or more used to be commonly applied to members subjected to general working, such as bumper reinforcements and door impact beams. The application of such steel sheets to automobile framework parts having various complicated shapes due to press forming has recently been studied to ensure further collision safety and to improve fuel efficiency by reducing the weight of vehicle bodies. Therefore, steel sheets having excellent formability are highly demanded.

However, increase in the strength of the steel sheets is in general likely to be accompanied by reduction in their formability. Accordingly, prevention of fractures caused during press forming has been a major challenge in promoting the application of high strength steel sheets. Further, in cases where the strength of the steel is increased to TS: 1180 MPa or more in particular, extremely expensive rare elements such as Nb, V, Cu, Ni, Cr, and Mo are often required to be intentionally added in addition to C and Mn in order to ensure sufficient strength.

Examples of the conventional techniques regarding a high-strength cold-rolled steel sheet having excellent formability include such techniques of obtaining a high-strength cold-rolled steel sheet having martensite phase or retained austenite phase as a constituent phase of the steel composition through restriction of the steel components and microstructure and optimization of hot rolling and annealing conditions for the production of the steel sheets as disclosed in PTL 1 (JP 2004-308002 A), PTL 2 (JP 2005-179703 A), PTL 3 (JP 2006-283130 A), PTL 4 (JP 2004-359974 A), PTL 5 (JP 2010-285657 A), PTL 6 (JP 2010-059452 A), and PTL 7 (JP 2004-068050 A).

PATENT LITERATURE

PTL 1: JP 2004-308002 A
PTL 2: JP 2005-179703 A
PTL 3: JP 2006-283130 A
PTL 4: JP 2004-359974 A
PTL 5: JP 2010-285657 A
PTL 6: JP 2010-059452 A
PTL 7: JP 2004-068050 A

SUMMARY OF INVENTION

In PTL 1, expensive elements may be not required; however, the specific component system disclosed by PTL 1 is a component system having a high C content of C≥0.3%, which would affect spot weldability. Further, PTL 1 discloses findings about achieving high elongation (El) with a component system having high C content; however, it does not disclose any findings about balancing stretch flangeability and bending properties in addition to El at a low C level content of C<0.3%.

In PTL 2, the steel sheet has a disadvantage in that it necessitates Cu or Ni as an austenite-stabilizing element. PTL 2 discloses findings about achieving high level El at the level of TS: 780 MPa to 980 MPa by using retained austenite. However, for example, high strength steel with TS: 1180 MPa or more having high C content cannot have sufficient stretch flangeability. Further, PTL 2 discloses no findings about improvement in bending properties.

In PTL 3, tempered martensite phase has high volume fraction, and it is difficult to achieve excellent balance between TS and El in a high strength steel sheet having TS: 1180 MPa or more. Further, PTL 3 does not disclose any findings about improvement in stretch flangeability and bending properties.

In PTL 4, expensive Mo or V is necessary.

In PTL 5, the steel sheet contains a small amount of retained austenite, and favorable elongation would not be ensured when a high strength, in particular, TS: 1180 MPa or more is targeted.

In PTL 6, it is directed to obtaining a cold rolled steel sheet having good elongation and bending properties at a strength level of TS: 780 MPa or more. However, the volume fraction of martensite phase in the steel sheet is low; the specific TS level disclosed is low as less than 1100 MPa; and the maximum of the elongation disclosed is about 18%. Accordingly, this technique would not be capable of ensuring good balance between TS and El in achieving high strength of TS: 1180 MPa or more.

In PTL 7, a technique for obtaining good bending properties at a high strength of TS: 780 MPa or more is also disclosed. However, the specific TS level disclosed is low as less than 1100 MPa, and the maximum of the elongation disclosed is about 18%. Accordingly, this technique would not be capable of ensuring good balance between TS and El in achieving high strength of TS: 1180 MPa or more.

The present invention is created in view of the above circumstances, and the present invention includes providing a high-strength cold-rolled steel sheet having a tensile strength TS of 1180 MPa or more with improved elongation, stretch flangeability, and bending properties by preparing metallographic structure in a component system free of expensive alloy elements such as Nb, V, Cu, Ni, Cr, or Mo. The present invention also provides a method for advantageously manufacturing the same.

As a result of the present inventors have keen study made by the present inventors to solve the above problems, they found that, in terms of weldability and formability, it is possible to realize a high strength steel sheet having tensile strength (TS): 1180 MPa or more while achieving improvement in elongation, stretch flangeability, and bending properties of the steel without adding C or expensive rare metals to the steel by strictly controlling metallographic structure, in particular, volume fraction of bainite phase generated in low temperature transformation from austenite, volume fraction of tempered martensite phase, and volume fraction of retained austenite phase.

The present invention is based on the aforementioned findings.

Specifically, primary features of embodiments of the present invention are as follows.

1. A high-strength cold-rolled steel sheet having a chemical composition containing by mass %:

C: 0.12% to 0.22%;
Si: 0.8% to 1.8%;
Mn: 2.2% to 3.2%;
P: 0.020% or less;
S: 0.0040% or less;
Al: 0.005% to 0.08%;
N: 0.008% or less;
Ti: 0.001% to 0.040%;
B: 0.0001% to 0.0020%; and
the remainder being Fe and incidental impurities, wherein the steel sheet has a microstructure including ferrite phase: 40% to 60%, bainite phase: 10% to 30%, tempered martensite phase: 20% to 40%, and retained austenite phase: 5% to 20% by volume fraction, and satisfying a condition that a ratio of tempered martensite phase having major axis length ≤5 μm to a total volume fraction of the tempered martensite phase is 80% to 100%.

2. A method for manufacturing a high-strength cold-rolled steel sheet comprising subjecting a steel slab having the chemical composition according to Claim 1 to hot rolling, pickling, first annealing at a temperature in a range of 350° C. to 650° C., cold rolling, second annealing at a temperature in a range of 820° C. to 900° C., third annealing at a temperature in a range of 720° C. to 800° C., cooling at a cooling rate: 10° C./s to 80° C./s down to a cooling stop temperature: 300° C. to 500° C., retention at the above cooling stop temperature range for 100 s to 1000 s, and fourth annealing at a temperature in a range of 100° C. to 300° C.

The present invention can provide a high-strength cold-rolled steel sheet having excellent elongation, stretch flangeability, bending properties, and a tensile strength of 1180 MPa or more, without adding expensive alloy elements into the steel sheet. The high-strength cold-rolled steel sheet obtained by the present invention is suitably used in particular for framework parts of automobiles which are to be subjected to a demanding press-forming.

DETAILED DESCRIPTION OF EMBODIMENTS OF THE INVENTION

The present invention will be described in detail below with reference to exemplary embodiments.

The inventors made various studies to improve formability of high-strength cold-rolled steel sheets and consequently found that an intended result can be advantageously achieved by strictly controlling the volume fractions of ferrite phase, bainite phase, tempered martensite phase, and retained austenite phase, and making the tempered martensite phase have fine and homogeneous microstructure with a component system free of extremely expensive rare elements such as Nb, V, Cu, Ni, Cr, or Mo. Thus, the present invention was completed.

Reasons for the preferred chemical composition and microstructure of a cold rolled steel sheet of the present invention will be described in detail below.

Preferred content ranges of components of a chemical composition of the steel in the present invention and reasons for specifying the component contents to the preferred content ranges will be described below. In addition, although the unit of content of each element included in the steel sheet is "mass %," it will be simply expressed by "%," unless otherwise specified.

C: 0.12% to 0.22%

Carbon (C) effectively contributes to ensuring sufficient strength by microstructure control using solid solution strengthening and a low temperature transformation phase. Further, carbon is an essential element to ensure sufficient retained austenite phase. Carbon is also an element that has an influence on the volume fraction of martensite phase and the hardness of martensite phase, and also on the stretch flangeability of the steel. In this respect, C content of less than 0.12% makes it difficult to obtain martensite phase of necessary volume fraction, whereas C content exceeding 0.22% not only significantly deteriorates spot weldability but also leads to excessive hardening of martensite phase and increase in the volume fraction of martensite phase, accompanied by excessive increase in TS. Thus, formability of the steel is deteriorated and stretch flangeability thereof is particularly deteriorated. Accordingly, the C content is to be in the range of 0.12% to 0.22%, preferably in the range of 0.16% to 0.20%.

Si: 0.8% to 1.8%

Silicon (Si) is an important element for promoting concentration of carbon into austenite phase to suppress generation of carbides thereby stabilizing the retained austenite phase. The content of Si is necessarily at least 0.8% to obtain the above effect. However, if the content of Si added to steel exceeds 1.8%, the steel sheet would become brittle and susceptible to fractures. Further, formability of the steel also decreases. Accordingly, the content of Si in steel is to be in the range of 0.8% to 1.8%, preferably in the range of 1.0% to 1.6%.

Mn: 2.2% to 3.2%

Manganese (Mn) is an element for improving hardenability of the steel, and helps to easily ensure a low temperature transformation phase that contributes to high strength of the steel. The manganese content need be at least 2.2% in order to obtain the above effect. On the other hand, Mn content exceeding 3.2% causes a band structure due to its segregation, which disturbs uniform forming in stretch flange forming and bending. Accordingly, the content of Mn in steel is to be in the range of 2.2% to 3.2%, preferably in the range of 2.6% to 3.0%.

P: 0.020% or Less

Phosphorus (P) not only adversely affects spot weldability, but also segregates at grain boundaries to induce cracks at the grain boundaries, thereby deteriorating formability. Accordingly, P content is preferably reduced as much as possible, although the P content of up to 0.020% is allowed. Reducing phosphorus to an exceedingly low level, however, decreases production efficiency in steel making process and increases production cost. Accordingly, the preferable lower limit of phosphorus content in steel is around 0.001%.

S: 0.0040% or Less

Sulfur (S) forms a sulfide inclusion such as MnS. The MnS is expand by cold rolling to be a start point of cracking during deformation, so that local deformability of the steel is reduced. Therefore, sulfur in steel is preferably reduced as much as possible, although S content up to 0.0040% is allowed. Reducing sulfur content to an exceedingly low level, however, is industrially difficult and increases desulfurizing cost in steel making process. Accordingly, the preferable lower limit of the sulfur content is around 0.0001%. The preferred range of S content is 0.0001% to 0.0030%.

Al: 0.005% to 0.08%

Aluminum (Al) is added mainly for the purpose of deoxidation. Further, Al is effective in producing retained austenite phase by suppressing production of carbides, and Al is also a useful element for improving the strength-elongation balance. In order to achieve the above objectives, Al content need be 0.005% or more. However, the Al content exceeding 0.08% deteriorates formability due to increase in inclusions such as alumina. Accordingly, the Al content is to be in the range of 0.005% to 0.08%, preferably in the range of 0.02% to 0.06%.

N: 0.008% or Less

Nitrogen (N) is an element that deteriorates aging resistance. When N content exceeds 0.008%, aging resistance significantly deteriorates. Further, when boron is added, N bonded to B forms BN to consume B, which deteriorates hardenability derived from solute B. This makes it difficult to ensure martensite phase having a predetermined volume fraction. Further, N is present as an impurity element in ferrite phase, and deteriorates ductility due to strain aging. Therefore, the N content is preferably lower, although N content up to 0.008% is allowed. Reducing nitrogen to an exceedingly low level, however, increases nitrogen removal cost in steel making process. Accordingly, the lower limit of N content is preferably about 0.0001%. Therefore, the preferred range of N content is 0.001% to 0.006%.

Ti: 0.001% to 0.040%

Titanium (Ti) forms carbonitride or sulfides in steel and effectively contributes to improvement in the strength of the steel. When boron is added, titanium fixes nitrogen as TiN to suppress formation of BN. Thus, Ti is an element which is also effective in realizing hardenability due to B. In order to realize these effects, the Ti content need be 0.001% or more. However, Ti content exceeding 0.040% excessively precipitates Ti in the ferrite phase, which results in degradation in elongation due to excessive precipitation strengthening. Accordingly, titanium content in steel is to be in the range of 0.001% to 0.040%, preferably in the range of 0.010% to 0.030%.

B: 0.0001% to 0.0020%

Boron (B) effectively contributes to enhancing hardenability of the steel to ensure low temperature transformation phase such as martensite phase and retained austenite phase, and boron is a useful element for obtaining excellent strength-elongation balance. In order to obtain such an effect, the B content need be 0.0001% or more. However, B content exceeding 0.0020% saturates the above effect. Accordingly, the boron content is to be in the range of 0.0001% to 0.0020%.

In a steel sheet of the present invention, components other than the components mentioned above are iron (Fe) and incidental impurities. However, the present invention does not exclude the possibility that the chemical composition thereof includes a component other than those described above unless inclusion of the component adversely affects the effects of the present invention.

Next, the preferred ranges regarding steel microstructure, which ranges are critically important in the present invention, and reasons for restricting steel microstructure to such ranges will be described hereinafter.

Volume Fraction of Ferrite Phase: 40% to 60%

Ferrite phase is soft and contributes to improvement in ductility. The volume fraction of ferrite phase need be 40% or more to obtain the desired elongation. When the volume fraction of ferrite phase is lower than 40%, the volume fraction of hard tempered martensite phase increases to excessively increase strength of the steel, so that the elongation and stretch flangeability of the steel are deteriorated. On the other hand, ferrite phase having a volume fraction exceeding 60% makes it difficult to ensure strength: 1180 MPa or more. Accordingly, the volume fraction of ferrite phase is in the range of 40% to 60%, preferably in the range of 40% to 55%.

Volume Fraction of Bainite Phase: 10% to 30%

Promotion of bainite transformation promotes concentration of C into austenite phase. In order to ensure a given amount of retained austenite phase which finally contributes to elongation, the volume fraction of bainite phase need be 10% or more. On the other hand, bainite phase having a volume fraction exceeding 30% excessively increases the strength of the steel to more than TS: 1180 MPa, which makes it difficult to ensure sufficient elongation of the steel. Accordingly, the volume fraction of bainite phase is in the range of 10% to 30%, preferably in the range of 15% to 25%.

Volume Fraction of Tempered Martensite Phase: 20% to 40%

Tempered martensite phase obtained by reheating the hard martensite phase contributes to increase in the strength of the steel. In order to ensure strength of TS: 1180 MPa or more, the volume fraction of tempered martensite phase need be 20% or more. However, excessively high volume fraction of tempered martensite phase excessively increases the strength of the steel to reduce elongation of the steel. Accordingly, the volume fraction of tempered martensite phase need be 40% or less. With such microstructure having a volume fraction of tempered martensite phase in the range of 20% to 40%, a balanced material having good strength, elongation, stretch flangeability, and bending properties can be obtained. The volume faction of tempered martensite is preferably in the range of 25% to 35%.

Volume Fraction of Retained Austenite Phase: 5% to 20%

When retained austenite phase is subjected to strain-induced transformation, that is, transformation of a part of retained austenite phase into martensite phase due to strain caused by deformation of material, the deformed part is hardened, which prevents concentration of strains and improves ductility of the steel. In order to obtain high ductility, the volume fraction of retained austenite phase contained in steel need be 5% or more. However, retained austenite phase is hard due to high C concentration; therefore, when volume fraction of retained austenite phase in a steel sheet is excessively high to exceed 20%, the steel sheet is locally hardened. This inhibits homogeneous deformation of the steel material during elongation and stretch flange forming, which makes it difficult to ensure excellent elongation and stretch flangeability. In particular, in terms of stretch flangeability, less retained austenite is preferable. Accordingly, the volume fraction of retained austenite phase is to be 5% to 20%, preferably in the range of 7% to 18%.

Ratio of Tempered Martensite Phase Having Major Axis Length ≤5 μm to Total Volume Fraction of the Tempered Martensite Phase: 80% to 100%

Tempered martensite phase is harder than ferrite phase as a base microstructure. In the case of the same total volume fraction of the tempered martensite phase, a small ratio of tempered martensite phase having a major axis of 5 μm or less leads to localization of coarse tempered martensite phase. This inhibits uniform deformation, and results in disadvantageous stretch flangeability as compared with fine and homogeneous microstructure which exhibits more uniform deformation. Accordingly, a lower ratio of coarse tempered martensite phase and a higher ratio of fine tempered martensite phase are preferred. Thus, the ratio of tempered martensite phase having major axis length ≤5 μm to a total volume fraction of the tempered martensite phase is to be in the range of 80% to 100%, preferably in the range of 85% to 100%.

Note that "major axis" here means the maximum diameter of the respective tempered martensite phase observed by the observation of the microstructure in a cross section of the steel sheet along the rolling direction.

Next, a method for manufacturing a high-strength cold-rolled steel sheet of the present invention will be described.

In the present invention, a hot-rolled steel sheet obtained by hot rolling and subsequent pickling is preferably subjected to annealing at a temperature in the range of 350° C. to 650° C. (first annealing), cold rolling, annealing at a temperature in the range of 820° C. to 900° C. (second annealing), annealing at a temperature in the range of 720° C. to 800° C. (third annealing), cooling at a cooling rate of 10° C./s to 80° C./s to a cooling stop temperature of 300° C. to 500° C., retention at the above cooling stop temperature range for 100 s to 1000 s, and another annealing at a temperature in the range of 100° C. to 300° C. (fourth annealing). Thus, a high-strength cold-rolled steel sheet targeted by the present invention can be obtained. The steel sheet may subsequently be subjected to skin pass rolling.

The limited ranges of the manufacturing conditions and grounds for the limitation will be described in detail below.

Annealing Temperature (First): 350° C. to 650° C.

In the present invention, the first annealing is preferably performed after hot rolling and pickling; annealing temperature on this occasion lower than 350° C. can be insufficient for tempering after hot rolling, which leads to inhomogeneous microstructure in which ferrite, martensite, and bainite are mixed. Such a hot rolled steel sheet microstructure causes insufficiently homogeneous refinement of the steel. Thus, the increased ratio of coarse martensite in the final annealing material after the fourth annealing results in inhomogeneous microstructure, so that stretch flangeability of the final annealing material is deteriorated.

On the other hand, first annealing temperature exceeding 650° C. results in coarse dual phase structure having ferrite and martensite or ferrite and pearlite is inhomogeneous and hardened, and accordingly inhomogeneous microstructure before cold rolling. Thus, the ratio of coarse martensite in the final annealing material, and stretch flangeability of the final annealing material is reduced as well in this case. In order to finally obtain a significantly homogeneous microstructure, the annealing temperature of the first annealing after this hot rolling need be in the range of 350° C. to 650° C.

Annealing Temperature (Second): 820° C. to 900° C.

When the annealing temperature of the second annealing performed after cold rolling is lower than 820° C., concentration of C into austenite phase is excessively promoted during annealing, thereby excessively hardening martensite phase. Thus, the steel sheet has hard and inhomogeneous microstructure even after final annealing, which reduces stretch flangeability. On the other hand, when the steel sheet is heated to a high temperature range of austenite single-phase exceeding 900° C. in the second annealing, the steel is homogeneous but grain size of the austenite are excessively coarse. Thus, the ratio of coarse martensite phase in the final annealing material is increased to reduce stretch flangeability of the final annealing material. Accordingly, the annealing temperature of the second annealing is to be in the range of 820° C. to 900° C.

Conditions other than the annealing temperature are not particularly restricted and the annealing may be carried out according to a conventional method. The conditions preferably include, cooling rate: 10° C./s to 80° C./s to the cooling stop temperature, cooling stop temperature: 300° C. to 500° C., retention time: 100 s to 1000 s in the cooling stop temperature range, for the following reasons. Specifically, when the average cooling rate after annealing is lower than 10° C./s, ferrite phase is excessively produced, which makes it difficult to ensure bainite phase and martensite phase and renders the steel sheet to have softened and inhomogeneous microstructure. This results in final annealing material having inhomogeneous microstructure; thus, formability such as elongation and stretch flangeability of the steel are likely to be deteriorated. On the other hand, when the average cooling rate after annealing exceeds 80° C./s, rather excessive production of martensite excessively hardens the steel sheet, which results in an excessively hardened final annealing material. Thus, formability such as elongation and stretch flangeability of the resultant steel is likely to be reduced.

The cooling in the annealing is preferably performed by gas cooling; however, furnace cooling, mist cooling, roll cooling, water cooling, and the like can also be employed in combination. Further, when the cooling stop temperature after cooling in the annealing is less than 300° C., the production of retained austenite phase is suppressed, which leads to excessive production of martensite phase. This results in excessively high strength of the steel sheet and difficulty in ensuring sufficient elongation of a final annealing material. On the other hand, the cooling stop temperature exceeding 500° C. suppresses production of retained austenite phase, which makes it difficult to obtain excellent ductility of the final annealing material. The cooling stop temperature after cooling in the annealing process is preferably in the range of 300° C. to 500° C. in order that the final annealing material having ferrite phase as a main phase as well as tempered martensite phase and retained austenite phase has a controlled abundance ratio; the steel strength of TS: 1180 MPa or more is ensured: and well balanced elongation and stretch flangeability can be obtained. Retention time of shorter than 100 s is insufficient for promotion of concentration of C into austenite phase, making it difficult to obtain desired volume fraction of retained austenite phase in the final annealing material. Thus, the elongation of the steel sheet is deteriorated. On the other hand, retention of more than 1000 s does not increase the amount of retained austenite, nor improve elongation. Instead, the elongation is likely to be saturated. Thus, the retention time is preferably in the range of 100 s to 1000 s.

Annealing Temperature (Third): 720° C. to 800° C.

When the annealing temperature of the third annealing is lower than 720° C., the volume fraction of ferrite phase is excessively high, which makes it difficult to ensure sufficient strength of TS: 1180 MPa or more. On the other hand, in a case of annealing at higher than 800° C. in a dual phase temperature region, the volume fraction of the austenite phase during the heating is increased, and the concentration of C in the austenite phase is reduced. Accordingly, the strength of the martensite phase to be finally obtained is reduced, which means it is difficult to ensure the strength of TS: 1180 MPa or more. If the annealing is performed at a higher annealing temperature in the austenite single phase temperature region, the strength of TS: 1180 MPa can be ensured; however, the volume fraction of ferrite phase is reduced while the volume fraction martensite phase is increased, which results in difficulties to ensure sufficient El. Accordingly, the annealing temperature of the third annealing is to be in the range of 720° C. to 800° C.

Cooling Rate: 10° C./s to 80° C./s

The rate of cooling after the third annealing is important in terms of obtaining the desired volume fraction of a low temperature transformation phase. When the average cooling rate in the cooling process is less than 10° C./s, it is difficult to ensure sufficient bainite phase and martensite phase. Accordingly, an excessive amount of ferrite phase is produced, and the steel sheet is softened. Thus, it is difficult to ensure sufficient strength of the steel sheet. On the other hand, when the cooling rate after the third annealing exceeds 80° C./s, excessive production of martensite excessively hardens steel, which results in deterioration of formability such as elongation and stretch flangeability.

This cooling is preferably performed by gas cooling; however, furnace cooling, mist cooling, roll cooling, water cooling, and the like can be employed in combination.

Cooling Stop Temperature: 300° C. to 500° C.

When the cooling stop temperature of the cooling process after the third annealing is less than 300° C., the production of retained austenite is suppressed, which leads to excessive production of martensite phase. This results in excessively high strength and difficulty in ensuring sufficient elongation of the steel. On the other hand, the cooling stop temperature exceeding 500° C. suppresses production of retained austenite phase, which makes it difficult to obtain excellent ductility of the steel sheet. This cooling stop temperature need be in the range of 300° C. to 500° C. in order that the steel sheet has ferrite phase as a main phase as well as martensite phase and retained austenite phase having a controlled abundance ratio; the strength of TS: 1180 MPa or more is ensured: and well balanced elongation and stretch flangeability can be obtained.

Retention Time: 100 s to 1000 s

The retention time at the above described cooling stop temperature of less than 100 s is insufficient for promotion of concentration of C into austenite phase; making it hard to obtain the desired volume fraction of retained austenite phase in the resultant steel sheet. Thus, the elongation and stretch flangeability of the steel sheet is deteriorated due to excessive production of martensite phase leading to excessively high strength. On the other hand, retention of more than 1000 s does not increase the volume fraction of retained austenite phase, nor improve elongation of the steel. Instead, the elongation is likely to be saturated. Therefore, the retention time is to be in the range of 100 s to 1000 s. The cooling after the retention need not be limited in particular, and the cooling may be performed to the desired temperature by a given method.

Annealing Temperature (Fourth): 100° C. to 300° C.

When the fourth annealing temperature is lower than 100° C., the martensite phase is not sufficiently softened by tempering, leading to excessive hardening of the steel. Thus, stretch flangeability and bending properties of the steel are reduced. On the other hand, if the annealing temperature exceeds 300° C., the martensite phase is excessively softened to make it hard to ensure TS: 1180 MPa or more. Moreover, the retained austenite phase obtained after third CAL (continuous annealing) is decomposed, so that retained austenite phase can never have the desired volume fraction. Thus, it is difficult to obtain a steel sheet having excellent TS-El balance. Accordingly, the annealing temperature of the fourth annealing is to be in the range of 100° C. to 300° C.

Note that the first to fourth annealing processes may be performed by any annealing method as long as the above conditions are met, and the method may be whether continuous annealing or box annealing.

Other preferable production conditions are as follows.

A slab may be produced by thin slab casting or ingot casting; however, the slab is preferably produced by continuous casting method in order to reduce segregation.

The heating temperature of hot rolling is preferably 1100° C. or higher. In terms of reduction in generation of scales and reduction in fuel consumption rate, the upper limit of the heating temperature is preferably 1300° C.

The hot rolling is preferably finish rolling at 850° C. or more thereby preventing lamellar structure of low temperature transformation phase such as ferrite and pearlite. Further, in terms of reducing generation of scales and making structures fine and homogeneous by suppressing coarsening of crystal grains, the upper limit of the hot rolling temperature is preferably 950° C.

After the hot rolling, cooling is performed as appropriate until coiling, and the cooling conditions are not limited in particular.

The coiling temperature after hot rolling is preferably 450° C. to 600° C. in terms of cold roll ability and surface quality. The steel sheet which has been coiled is subjected to pickling, the above described annealing (first), cold rolling process, and then to the above described annealing processes (second to fourth). The pickling after hot rolling can be performed by a conventional method. Further, the cold rolling is preferably performed at a reduction rate of % or more in terms of suppressing coarsening of grains during recrystallization in annealing processes or production of inhomogeneous microstructure. Although the reduction rate is permitted to be high, it is preferably 60% or less so as to keep from increasing rolling road.

A cold rolled steel sheet obtained as described above may be subjected to temper rolling (skin pass rolling) for shape correction and surface roughness adjustment. However, excessive skin pass rolling introduces strain into the steel sheet and extends crystal grains in the rolling direction. And then, ductility of the steel sheet may deteriorate. Accordingly, the reduction rate of the skin pass rolling is preferably 0.05% to 0.5%.

EXAMPLES

Steel samples having respective chemical compositions shown in Table 1 were smelted to obtain slabs. Each of the slabs were subjected to heating to 1220° C., hot rolling at a finisher delivery temperature of 880° C., and cooling at a rate of 50° C./s immediately after the rolling, coiling at 550° C., hydrochloric acid pickling, first annealing process under the conditions shown in Table 2, and then cold rolling. Thus, the slabs were finished as cold rolled steel sheets having a sheet thickness of 1.6 mm.

Subsequently, the cold rolled steel sheets thus obtained were subjected to second to fourth annealing processes under the conditions shown in Table 2. The cooling after the second annealing was performed under the above described preferable conditions: cooling rate: 10° C./s to 80° C./s to the cooling stop temperature, cooling stop temperature: 300° C. to 500° C., and retention time in the cooling stop temperature range: in the range of 100 s to 1000 s. Material properties of each of the cold rolled steel sheet samples thus obtained were investigated by the material tests described below.

The obtained results are shown in Table 3. Note that the underlined values in Tables 2 and 3 indicate that these values are out of the scope of the present invention.

(1) Structure of the Steel Sheet

Structure of each of the cold rolled steel sheet samples was analyzed by observing the sheet thickness×¼ position of a steel sheet section cut along the rolling direction of the steel sheet sample by a scanning electron microscope (SEM). The observation was carried out with N=5 (i.e. with five observation fields). For the volume fraction of ferrite phase in which no precipitates such as carbides were observed (polygonal ferrite phase), the area occupied by the ferrite phase present in a given 50 μm×50 μm square area was determined by image analysis using a ×2000 sectional micrograph of the microstructure. As described above, the volume fraction of the ferrite phase was calculated.

The volume fraction of retained austenite phase was determined by the X-ray diffraction method using Mo K-alpha X-ray. Specifically, the volume fraction of retained austenite phase was calculated based on peak intensities of (211) plane and (220) plane of austenite phase and (200) plane and (220) plane of ferrite phase by using a steel sheet test piece and analyzing, as a measurement surface, a surface thereof in the vicinity of ¼ depth position in sheet thickness direction.

For the volume fraction of tempered martensite phase, the microstructure was observed with a scanning electron microscope (SEM) before and after the fourth annealing, the microstructure observed to have a relatively smooth surface in massive form before tempering was eventually temper annealed. When fine carbides were found to precipitate inside a microstructure, the microstructure was defined as tempered martensite phase. And, the area ratio of the tempered martensite phase was measured and determined as the volume fraction of the tempered martensite phase. Each of the samples were observed using a ×2000 sectional micrograph of the microstructure, and the area occupied by the tempered martensite phase in a given 50 μm×50 μm square area was determined. Only when the temperature of the fourth final annealing was lower than 100° C., the structure observed to have a smooth surface in massive form without spot-like carbides in the surface after the fourth final annealing was specified as a mixture of retained austenite phase and martensite phase. The difference between the total volume fraction of the mixed phase and the volume fraction of the retained austenite determined by x-ray diffraction was determined as the volume fraction of the martensite phase which has not been tempered.

The ratio of tempered martensite phase having a major axis diameter of 5 μm or less was determined by calculating the ratio of tempered martensite phase having a major axis diameter of more than 5 μm. Specifically, the ratio of the area occupied by the tempered martensite phase having a major axis diameter of more than 5 μm present in a given 50 μm×50 μm square area was determined by image analysis of the tempered martensite phase larger than 5 μm using a ×2000 sectional micrograph of the microstructure in the rolling direction. The thus obtained area ratio was subtracted from a whole to obtain the volume fraction of the tempered martensite phase having a major axis diameter of 5 μm or less. The "major axis" here refers to the maximum diameter of each of the tempered martensite phase.

First, ferrite phase and low temperature transformation phase were distinguished, and the volume fraction of the ferrite phase was determined. Next, the volume fraction of retained austenite phase was determined by x-ray diffraction, and the volume fraction of the tempered martensite phase was then found by SEM observation as described above. The final balance was regarded as bainite phase. Thus, the volume fraction of each phase was determined.

(2) Tensile Properties

A tensile test was carried out according to JIS Z 2241 to evaluate tensile properties of No. 5 test samples prepared according to JIS Z 2201 having the longitudinal (tensile) direction thereof oriented at 90° to the rolling direction. For evaluation criteria of tensile properties, samples having TS×El≥20000 MPa·% (TS: tensile strength (MPa) and El: total elongation (%)) was evaluated as having good tensile properties.

(3) Hole Expansion Ratio

A test was carried out based on the Japan Iron and Steel Federation Standard JFS T 1001. A hole having an initial diameter of $d_0$=10 mm was punched in each sample. A conical punch having a vertical angle of 60° was raised to expand the hole until fracture penetrates through the sheet thickness. The punch diameter d after the fracture penetration was measured to calculate the hole expansion ratio (%)=$\{(d-d_0)/d_0\}\times100$. Steel sheets referenced with the same steel sample number were tested three times to find the mean value (λ) of the hole expansion ratios. Note that for the criteria of stretch flangeability (TS×λ), TS×λ≥35000 MPa·% or more was evaluated as favorable.

(4) Bending Properties

Samples were collected from a steel sheet having a sheet thickness of 1.6 mm such that the ridge of a bent portion of each sample is in parallel with the rolling direction. The samples were 40 mm×100 mm in size (longitudinal direction of each sample was perpendicular to the rolling direction). V bending (90°) was performed at bottoming load: 3 tons at the bottom dead point using a tip bending metallic die having radius of curvature R=1.0 mm, and whether the tip of the bend is fractured or not was determined by visual observation. Samples having no fractures were evaluated to have favorable bending properties.

TABLE 1

| Steel sample | Chemical composition (mass %) | | | | | | | | | |
|---|---|---|---|---|---|---|---|---|---|---|
| ID | C | Si | Mn | P | S | Al | N | Ti | B | Note |
| A | 0.180 | 1.45 | 2.80 | 0.004 | 0.0008 | 0.050 | 0.004 | 0.015 | 0.0005 | Conforming steel |
| B | 0.140 | 1.65 | 3.15 | 0.008 | 0.0006 | 0.040 | 0.005 | 0.020 | 0.0015 | Conforming steel |
| C | 0.210 | 1.25 | 2.40 | 0.012 | 0.0009 | 0.030 | 0.006 | 0.025 | 0.0010 | Conforming steel |

TABLE 1-continued

| Steel sample ID | Chemical composition (mass %) C | Si | Mn | P | S | Al | N | Ti | B | Note |
|---|---|---|---|---|---|---|---|---|---|---|
| D | 0.160 | 1.00 | 3.05 | 0.015 | 0.0005 | 0.060 | 0.003 | 0.030 | 0.0015 | Conforming steel |
| E | 0.190 | 1.55 | 2.65 | 0.006 | 0.0007 | 0.050 | 0.004 | 0.010 | 0.0005 | Conforming steel |
| F | 0.260 | 1.30 | 2.70 | 0.010 | 0.0008 | 0.040 | 0.004 | 0.020 | 0.0010 | Comparative steel |

TABLE 2

| No. | Steel sample ID | Annealing temperature (first) (° C.) | Annealing temperature (second) (° C.) | Annealing temperature (third) (° C.) | Cooling rate (° C./s) | Cooling stop temperature (° C.) | Retention time (s) | Annealing temperature (fourth) (° C.) | Note |
|---|---|---|---|---|---|---|---|---|---|
| 1 | A | 600 | 855 | 760 | 20 | 380 | 180 | 200 | Invention Example |
| 2 | B | 550 | 845 | 770 | 25 | 400 | 200 | 210 | Invention Example |
| 3 | C | 500 | 835 | 780 | 30 | 420 | 220 | 180 | Invention Example |
| 4 | D | 640 | 840 | 740 | 15 | 360 | 150 | 220 | Invention Example |
| 5 | E | 620 | 850 | 750 | 35 | 400 | 450 | 180 | Invention Example |
| 6 | F | 580 | 860 | 770 | 45 | 350 | 170 | 260 | Comparative Example |
| 7 | A | 150 | 870 | 790 | 55 | 375 | 190 | 140 | Comparative Example |
| 8 | A | 780 | 880 | 780 | 65 | 400 | 210 | 250 | Comparative Example |
| 9 | A | 550 | 740 | 770 | 75 | 425 | 230 | 150 | Comparative Example |
| 10 | A | 600 | 950 | 760 | 60 | 450 | 250 | 260 | Comparative Example |
| 11 | A | 650 | 855 | 700 | 50 | 350 | 300 | 160 | Comparative Example |
| 12 | A | 625 | 875 | 850 | 40 | 375 | 450 | 270 | Comparative Example |
| 13 | A | 575 | 890 | 780 | 5 | 400 | 550 | 170 | Comparative Example |
| 14 | A | 550 | 870 | 770 | 100 | 425 | 400 | 280 | Comparative Example |
| 15 | A | 525 | 850 | 760 | 30 | 200 | 300 | 180 | Comparative Example |
| 16 | A | 400 | 830 | 750 | 20 | 550 | 200 | 265 | Comparative Example |
| 17 | A | 450 | 820 | 740 | 15 | 400 | 30 | 175 | Comparative Example |
| 18 | A | 525 | 860 | 760 | 35 | 360 | 200 | 80 | Comparative Example |
| 19 | A | 575 | 880 | 770 | 45 | 420 | 150 | 350 | Comparative Example |

TABLE 3

| No. | Steel sample ID | Microstructure: Ferrite phase volume fraction (%) | Bainite phase volume fraction (%) | Tempered martensite phase volume fraction (%) | Retained austenite phase volume fraction (%) | Ratio of tempered martensite phase (major axis diameter ≤ 5 μm) (%) | Material properties: YP (MPa) | TS (MPa) | El (%) | λ (%) | Fractures at tip of bend | TS × El (MPa · %) | TS × λ (MPa · %) | Note |
|---|---|---|---|---|---|---|---|---|---|---|---|---|---|---|
| 1 | A | 42 | 15 | 34 | 9 | 86 | 875 | 1220 | 17.5 | 34 | No | 21350 | 41480 | Invention Example |
| 2 | B | 47 | 17 | 28 | 8 | 90 | 865 | 1200 | 17.5 | 31 | No | 21000 | 37200 | Invention Example |
| 3 | C | 49 | 15 | 27 | 9 | 87 | 860 | 1185 | 18.2 | 33 | No | 21567 | 39105 | Invention Example |
| 4 | D | 51 | 15 | 26 | 8 | 88 | 880 | 1180 | 18.5 | 32 | No | 21830 | 37760 | Invention Example |
| 5 | E | 48 | 19 | 25 | 8 | 86 | 870 | 1190 | 18.1 | 31 | No | 21539 | 36890 | Invention Example |
| 6 | F | 31 | 15 | 48 | 6 | 83 | 1125 | 1350 | 13.8 | 22 | Yes | 18630 | 29700 | Comparative Example |
| 7 | A | 42 | 17 | 30 | 11 | 65 | 900 | 1280 | 15.5 | 18 | Yes | 19840 | 23040 | Comparative Example |
| 8 | A | 47 | 18 | 29 | 6 | 55 | 1105 | 1300 | 14.8 | 17 | Yes | 19240 | 22100 | Comparative Example |
| 9 | A | 35 | 12 | 45 | 8 | 89 | 1080 | 1330 | 14.2 | 19 | Yes | 18886 | 25270 | Comparative Example |
| 10 | A | 45 | 16 | 33 | 6 | 60 | 990 | 1270 | 14.6 | 16 | Yes | 18542 | 20320 | Comparative Example |
| 11 | A | 78 | 11 | 7 | 4 | 100 | 720 | 1050 | 22.7 | 45 | No | 23835 | 47250 | Comparative Example |
| 12 | A | 32 | 24 | 39 | 5 | 82 | 1140 | 1290 | 14.4 | 26 | Yes | 18576 | 33540 | Comparative Example |
| 13 | A | 68 | 9 | 18 | 5 | 100 | 710 | 1080 | 23.1 | 48 | No | 24948 | 51840 | Comparative Example |
| 14 | A | 18 | 19 | 59 | 4 | 81 | 1165 | 1370 | 12.8 | 15 | Yes | 17536 | 20550 | Comparative Example |
| 15 | A | 32 | 16 | 48 | 4 | 82 | 990 | 1310 | 13.4 | 22 | Yes | 17554 | 28820 | Comparative Example |
| 16 | A | 56 | 18 | 22 | 4 | 93 | 860 | 1260 | 13.8 | 28 | Yes | 17388 | 35280 | Comparative Example |
| 17 | A | 34 | 8 | 55 | 3 | 85 | 1020 | 1340 | 11.9 | 16 | Yes | 15946 | 21440 | Comparative Example |
| 18 | A | 44 | 15 | (*33) | 8 | — | 1210 | 1380 | 12.7 | 9 | Yes | 17526 | 12420 | Comparative Example |
| 19 | A | 48 | 19 | 31 | 2 | 86 | 930 | 1020 | 19.3 | 52 | Yes | 19686 | 53040 | Comparative Example |

*Martensite which is not tempered since low temperature annealing was performed.

Table 3 shows the following.

In each of Invention Example samples No. 1 to 5, a high-strength cold-rolled steel sheet excellent in elongation, stretch flangeability, and bending properties was obtained. These cold rolled steel sheets satisfied TS×El≥20000 MPa·% or more at TS 1180 MPa and were V bent at 90° at TS×λ≥35000 MPa·% and R/t=1.0/1.6=0.625 without fractures.

Meanwhile, sample No. 6 having a steel component out of the proper range specified by the present invention, No. 9 of low second annealing temperature, No. 14 of excessively high cooling rate, No. 15 of low cooling stop temperature, and No. 17 of short retention time each had excessively high volume fraction of tempered martensite phase, excessively high steel strength, and poor elongation and stretch flangeability.

Sample No. 7 of low annealing temperature in first annealing after hot rolling, No. 8 of high annealing temperature, and No. 10 of high annealing temperature in second annealing had high ratio of coarse tempered martensite phase, leading to poor stretch flangeability.

Sample No. 11 of low annealing temperature in third annealing and No. 13 of slow cooling rate each had high volume fraction of ferrite phase, so that TS≥1180 MPa was not satisfied.

Sample No. 12 of high annealing temperature in third annealing had low volume fraction of ferrite phase and excessively high strength, resulting in poor elongation and stretch flangeability.

Sample No. 16 of high cooling stop temperature in third annealing and No. 19 of high temperature in temper annealing (fourth annealing) had low volume fraction of retained austenite, resulting in poor ductility. Further, martensite phase of No. 19 was excessively softened, so that TS≥1180 MPa was not satisfied.

Sample No. 18 of low temperature in temper annealing (fourth annealing) had insufficient volume fraction of tempered martensite phase and excessively high strength, resulting in poor stretch flangeability.

In accordance with the present invention, a high-strength cold-rolled steel sheet having tensile strength (TS): 1180 MPa or more and excellent formability can be obtained at low cost by appropriately controlling the volume fractions of ferrite phase, tempered martensite phase, retained austenite phase, and bainite phase without intentionally adding expensive elements such as Nb, V, Cu, Ni, Cr, Mo, etc. to the steel sheet.

Further, a high-strength cold-rolled steel sheet of the present invention is suitably used in particular for framework parts of automobiles. On top of that, it is advantageously used for applications such as architecture and consumer electrical appliances which require strict dimensional accuracy and good formability.

The invention claimed is:

1. A high-strength cold-rolled steel sheet having a chemical composition containing by mass %:

C: 0.12% to 0.22%;
Si: 0.8% to 1.8%;
Mn: 2.2% to 3.2%;
P: 0.020% or less;
S: 0.0040% or less;
Al: 0.005% to 0.08%;
N: 0.008% or less;
Ti: 0.001% to 0.040%;
B: 0.0001% to 0.0020%; and
the remainder being Fe and incidental impurities, wherein the steel sheet has a microstructure including ferrite phase: 40% to 60% by volume fraction, bainite phase: 10% to 30% by volume fraction, tempered martensite phase: 20% to 40% by volume fraction, and retained austenite phase: 5% to 20% by volume fraction, and satisfying a condition that a ratio of tempered martensite phase having major axis length ≤5 μm to a total volume fraction of the tempered martensite phase is 80% to 100%.

2. A method for manufacturing a high-strength cold-rolled steel sheet comprising subjecting a steel slab having the chemical composition according to claim 1 to hot rolling, coiling, pickling, first annealing at a temperature in a range of 350° C. to 650° C., cold rolling, second annealing at a temperature in a range of 820° C. to 900° C., third annealing at a temperature in a range of 720° C. to 800° C., cooling at a cooling rate: 10° C./s to 80° C./s down to a cooling stop temperature: 300° C. to 500° C., retention at the above cooling stop temperature range for 100 s to 1000 s, and fourth annealing at a temperature in a range of 100° C. to 300° C. to thereby obtain a steel sheet that has a microstructure including ferrite phase: 40% to 60% by volume fraction, bainite phase: 10% to 30% by volume fraction, tempered martensite phase: 20% to 40% by volume fraction, and retained austenite phase: 5% to 20% by volume fraction, and satisfying a condition that a ratio of tempered martensite phase having major axis length ≤5 μm to a total volume fraction of the tempered martensite phase is 80% to 100%, wherein the hot rolling, coiling, pickling, first annealing, cold rolling, second to third annealing, cooling, and fourth annealing are performed in this order.

3. The method of claim 2, wherein a temperature of the coiling is in a range of 450° C. to 600° C.

* * * * *